US010950926B2

(12) United States Patent
Guntupalli et al.

(10) Patent No.: US 10,950,926 B2
(45) Date of Patent: Mar. 16, 2021

(54) DUAL-BAND ANTENNA ELEMENT AND BASE STATION

(71) Applicant: Huawei Technologies Co., Ltd., Shenzhen (CN)

(72) Inventors: Ajay Babu Guntupalli, Munich (DE); Juan Segador Alvarez, Munich (DE); Serban Rebegea, Munich (DE); Bernhard Rist, Munich (DE); Bruno Biscontini, Munich (DE)

(73) Assignee: Huawei Technologies Co., Ltd., Shenzhen (CN)

( * ) Notice: Subject to any disclaimer, the term of this patent is extended or adjusted under 35 U.S.C. 154(b) by 12 days.

(21) Appl. No.: 16/432,462

(22) Filed: Jun. 5, 2019

(65) Prior Publication Data

US 2019/0312338 A1 Oct. 10, 2019

Related U.S. Application Data

(63) Continuation of application No. PCT/EP2016/079826, filed on Dec. 6, 2016.

(51) Int. Cl.

| | |
|---|---|
| ***H01Q 1/24*** | (2006.01) |
| ***H01Q 5/35*** | (2015.01) |
| ***H01Q 1/38*** | (2006.01) |
| ***H01Q 1/48*** | (2006.01) |
| ***H01Q 21/00*** | (2006.01) |
| ***H01Q 5/40*** | (2015.01) |
| ***H01Q 5/45*** | (2015.01) |
| *H01Q 21/06* | (2006.01) |

(52) U.S. Cl.

CPC ..... *H01Q 1/246* (2013.01); *H01Q 1/38* (2013.01); *H01Q 1/48* (2013.01); *H01Q 5/35* (2015.01); *H01Q 5/40* (2015.01); *H01Q 5/45* (2015.01); *H01Q 21/0075* (2013.01); *H01Q 21/062* (2013.01)

(58) Field of Classification Search

CPC .. H01Q 1/24; H01Q 5/35; H01Q 5/40; H01Q 5/45; H01Q 1/38; H01Q 1/48; H01Q 21/00; H01Q 21/06

USPC ..... 343/848

See application file for complete search history.

(56) References Cited

U.S. PATENT DOCUMENTS

2003/0222830 A1* 12/2003 Harel ..... H01Q 21/24 343/797

2004/0140942 A1 7/2004 Gottl

FOREIGN PATENT DOCUMENTS

| | | | |
|---|---|---|---|
| CN | 1462089 | A | 12/2003 |
| CN | 202888396 | U | 4/2013 |
| CN | 103151602 | A | 6/2013 |

(Continued)

*Primary Examiner* — Andrea Lindgren Baltzell

(74) *Attorney, Agent, or Firm* — Leydig, Voit & Mayer, Ltd.

(57) ABSTRACT

A dual band antenna element comprises a support structure being a single molded part; a first feeding circuit and a second feeding circuit both arranged on the support structure; and a first radiating element arranged on the support structure and configured to radiate in a first operating frequency band. The first radiating element is fed by the first feeding circuit. Furthermore, a second radiating element is arranged on the support structure and configured to radiate in a second operating frequency band that is lower than the first operating frequency band. The second radiating element is fed by the second feeding circuit.

18 Claims, 13 Drawing Sheets

(56) References Cited

FOREIGN PATENT DOCUMENTS

| | | | |
|---|---|---|---|
| CN | 203071221 | U | 7/2013 |
| EP | 2950385 | A1 | 12/2015 |
| EP | 2727183 | B1 | 11/2016 |
| EP | 3166178 | A1 | 5/2017 |
| EP | 3232504 | A1 | 10/2017 |
| WO | 2003065505 | A1 | 8/2003 |
| WO | 2012055883 | A1 | 5/2012 |
| WO | 2016062356 | A1 | 4/2016 |

* cited by examiner

DUAL-BAND ANTENNA ELEMENT AND BASE STATION

CROSS-REFERENCE TO RELATED APPLICATIONS

This application is a continuation of International Application No. PCT/EP2016/079826, filed on Dec. 6, 2016, the disclosure of which is hereby incorporated by reference in its entirety.

TECHNICAL FIELD

The present invention is directed to a dual-band antenna element and a base station comprising a plurality of said dual-band antenna elements.

BACKGROUND

Today's base station antennas are operating in multiple bands typically with ±45° polarization. Low-profile implementation of dual-band radiating elements plays a vital role for mass production. Printed circuit board technology was traditionally used to manufacture single or multiband elements. However, multiband antennas have more parts and hence multiple soldering joints.

Therefore, a problem of the present invention is to provide an improved concept for an antenna element.

SUMMARY OF THE INVENTION

In a first aspect, a dual-band antenna element preferably for a base station antenna is provided, wherein the dual-band antenna element comprises: a support structure being a single molded part; a first feeding circuit and a second feeding circuit both arranged on the support structure; a first radiating element configured to radiate in a first operating frequency band and arranged on the support structure; wherein the first radiating element is fed by the first feeding circuit; a second radiating element configured to radiate in a second operating frequency band being lower than the first operating frequency band and arranged on the support structure; and wherein the second radiating element is fed by the second feeding circuit.

In this context, the single molded part is a structure, which is a result of a molding process, for example, an injection molding process. Further, the first feeding circuit and the second feeding circuit can each be microstrip transmission lines. Accordingly, a dual-band antenna element is provided, which provides a high mechanical stability due to the provision of the single molded part. Further, due to the provision of the support structure as a single molded part a very simple and cost-effective manufacturing process of the dual-band antenna element is possible. Furthermore, the dual-band antenna element is very compact with only a few elements making up the dual-band antenna element, namely just the support structure, the first and second radiating element, which also reduces the number of any hand-soldered joints for connecting the elements of the dual band antenna element.

Hence, an improved dual-band antenna element is provided which is simple to manufacture, provides a minimum number of parts and hand-soldered joints and at the same time provides good mechanical stability.

In a first implementation form of the dual-band antenna element according to the first aspect, the support structure and the second radiating element are formed by a single molded partly metalized part; wherein the second radiating element is formed by a radiating element metallization on the single molded partly metalized part.

Thereby, a very compact arrangement can be provided, in which the second radiating element is just formed by a metallization on the support structure, thereby further reducing the dimensions of the dual-band antenna element.

In a second implementation form of the dual-band antenna element according to the first aspect, the second radiating element is a bended metal sheet attached to the support structure.

This is an alternative in comparison to the first implementation form mentioned above, which also contributes for arriving at a very mechanically stable dual-band antenna element, which is also very compact and easy to manufacture.

In a third implementation form of the dual-band antenna element according to the first aspect, the support structure comprises a top portion, a bottom portion and a first wall connecting the top portion and the bottom portion, wherein at least a portion of the first wall surrounds a hollow area; wherein the first radiating element is arranged at the top portion; further comprising a first metallization forming the first feeding circuit and a balun metallization forming a balun for the first radiating element; wherein the first metallization and the balun metallization are arranged on opposing sides of the first wall and extend from the bottom portion to the top portion.

Thereby, a very compact support structure can be provided in which, in a very effective way, the feeding of the first radiating element and the grounding of the first radiating element at the same time can be implemented.

In a fourth implementation form of the dual-band antenna element according to the first aspect, the support structure comprises an intermediate portion and a second wall connecting the bottom portion and the intermediate portion, wherein the first wall and the second wall enclose at least one cavity; wherein the second radiating element is arranged at the intermediate portion; further comprising a second metallization forming the second feeding circuit; wherein the second metallization is arranged on the second wall and extend from the bottom portion to the intermediate portion.

Also this implementation form serves for providing a very compact dual-band antenna element, which implements both, a first and a second radiating element and the corresponding feeding and grounding circuitry and is at the same time mechanically stable and easy to manufacture.

In a fifth implementation form of the dual-band antenna element according to the first aspect, the balun metallization is arranged on the side of the first wall facing the enclosed cavity and further extends along the side of the second wall facing the enclosed cavity, thereby serving as a ground plane for both, the first feeding circuit and the second feeding circuit.

Thereby, in a very effective way a grounding plane can be provided for both, the first and second feeding circuit, which also contributes for arriving at a very compact dual-band antenna element having at the same time mechanical stability.

In a sixth implementation form of the dual-band antenna element according to the first aspect, the second radiating element is a cup shaped element, having a bottom portion, a top portion and wall portion connecting the bottom portion and top portion.

Accordingly, this provides a very compact second radiating element, which can be attached to the support structure, thereby providing a very compact dual-band antenna element.

In a seventh implementation form of the dual-band antenna element according to the first aspect, the support structure comprises a bottom portion, an intermediate portion and a top portion, wherein the support structure extends from its bottom portion, through its intermediate portion to its top portion; wherein the second radiating element is arranged with its bottom portion on the intermediate portion of the support structure; wherein the bottom portion of the cup shaped element has an opening through which the support structure extends from the intermediate portion of the support structure to the top portion of support structure.

Accordingly, due to the opening in the cup-shaped element making up the second radiating element, it is possible to provide in a very compact way both, the first and second radiating elements at the same time on the support structure, thereby contributing to the above-mentioned advantages of the dual-band antenna element.

In an eighth implementation form of the dual-band antenna element according to the first aspect, the first radiating element is arranged at the top portion of the support structure.

This contributes for arriving at a very compact dual-band antenna element comprising the first radiating element and the second radiating element.

In a ninth implementation form of the dual-band antenna element according to the first aspect, the first radiating element is connected to the balun metallization.

Thereby, a grounding of the first radiating element can be provided in a very effective way, which also contributes for arriving at a very compact dual-band antenna element providing at the same time mechanical stability.

In a tenth implementation form of the dual-band antenna element according to the first aspect, the first feeding circuit comprises an open ended microstrip transmission line configured to feed the first radiating element and the second feeding circuit comprises a further open ended microstrip transmission line configured to feed the second radiating element.

Thereby, because of the use of open ended microstrip transmission lines no galvanic connection between the radiating elements and feeding circuits is needed, which provides more freedom for arranging the first radiating element, the first feeding circuit, the second radiating element and the second feeding circuit.

In an eleventh implementation form of the dual-band antenna element according to the first aspect, the dual-band antenna element further comprises a foot at a bottom portion of the support structure, the foot comprising at least a first input port and a second input port; wherein the first input port is connected to the first feeding circuit and the second input port is connected to the second feeding circuit; wherein the input ports are configured to be connected to a distribution network of a base station antenna.

Thereby, it is possible to effectively couple the dual-band antenna element to the distribution network of a base station antenna and ensuring at the same time the feeding of the first and second radiating elements.

Furthermore, in another possible implementation form of any of the preceding implementation forms of the first aspect or the first aspect as such, the radiating elements are dual polarized radiating elements. In such an implementation form each of the feeding circuits provides a feeding for each of the two different polarizations of the radiating element it is configured to feed.

Furthermore, in such implementation form with dual polarized radiating elements, where there is above mentioned foot arranged at the bottom portion of the support structure each input port pair comprises a first input port terminal for the first polarization and a second input port terminal for the second polarization. These input port terminals are connected to the corresponding feeding lines of the feeding circuits for the respective polarization.

In a twelfth implementation form of the dual-band antenna element according to the first aspect, the foot is a separate printed circuit board (PCB) soldered to the support structure.

This further contributes for arriving at a very compact dual-band antenna element.

In a thirteenth implementation form of the dual-band antenna element according to the first aspect, the support structure together with the foot form the single molded part.

Accordingly, a very compact dual-band antenna element being at the same time very stable can be provided. Furthermore, since the support structure and the foot together form the single molded product, no soldering joints are needed for attaching the support structure to the foot.

In a fourteenth implementation form of the dual-band antenna element according to the first aspect, the support structure together with the first radiating element and/or the second radiating element form the single molded part.

Accordingly, this is a further implementation form for providing a very compact and stable dual-band antenna element, which is also easy to manufacture and no soldering joints are needed for attaching the first radiating element and/or the second radiating element to the support structure.

In a fifteenth implementation form of the dual-band antenna element according to the first aspect, the first feeding circuit and the second feeding circuit are both formed by microstrip transmission lines.

This implementation form aims at focusing on that the first feeding circuit is a microstrip transmission line and the second feeding circuit is also a microstrip transmission line, which provides for a very easy and effective implementation form of providing feeding circuits for the corresponding first and second radiating elements.

In a sixteenth implementation form of the dual-band antenna element according to the first aspect, the dual-band antenna element is a molded interconnect device (MID).

This further contributes to the advantages mentioned above concerning the first aspect and its implementation forms.

In a second aspect, a base station is provided comprising a plurality of dual-band antenna elements according to the first aspect or the implementation forms of the first aspect.

BRIEF DESCRIPTION OF DRAWINGS

The above-described aspects and implementation forms of the present invention will be explained in the following description of exemplary embodiments in relation to enclosed drawings in which.

DETAILED DESCRIPTION OF THE FIGURES

Figure 1:
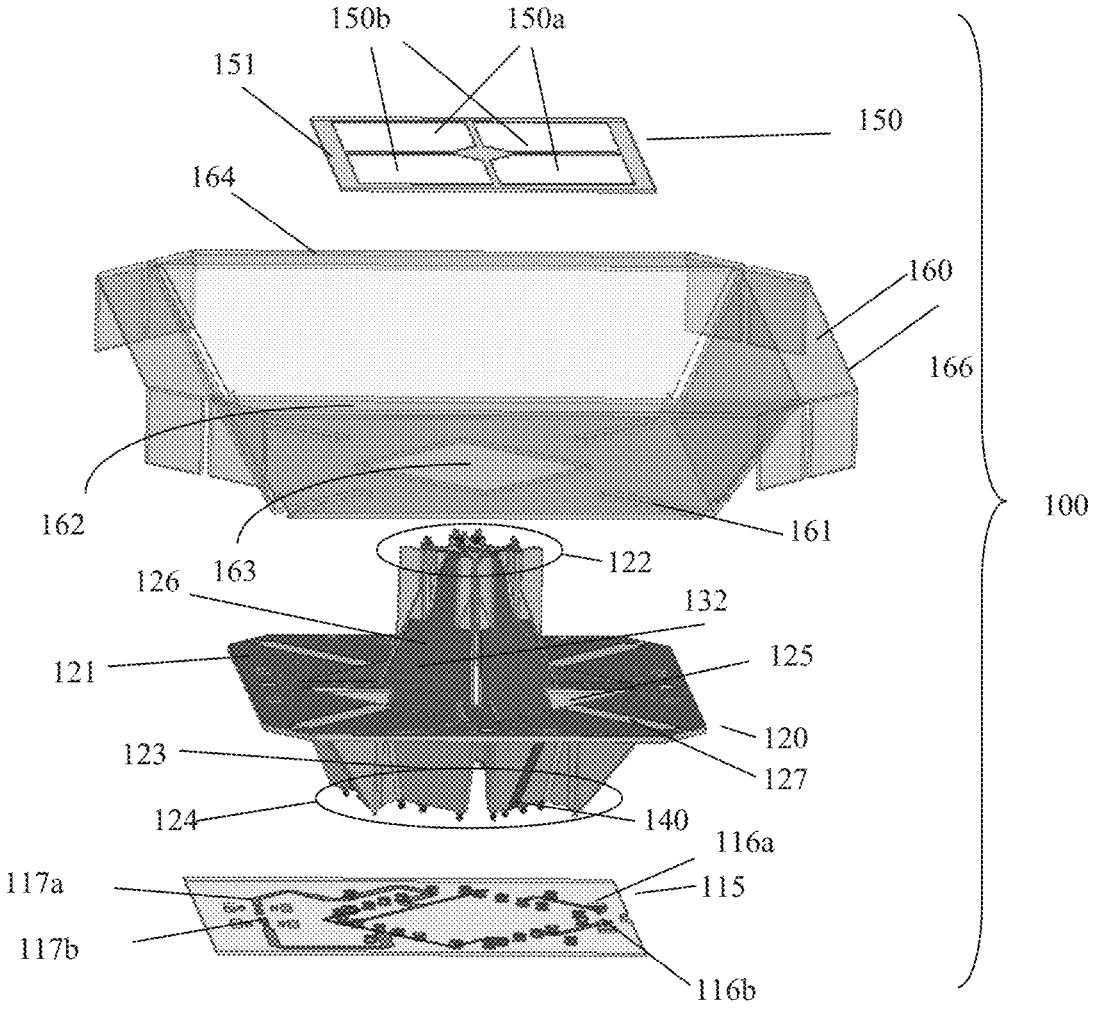
FIG. 1 shows an exploded view of a dual-band antenna element according to a first embodiment of the present invention.

FIG. 1 is an exploded view of a dual-band antenna element 100 preferably for a base station antenna, wherein the dual-band antenna element 100 comprises a support structure 120 being a single molded part, a first feeding circuit 130 (not visible in FIG. 1, but in FIG. 2) and a second feeding circuit 140 (only partly visible in FIG. 1, better to see in FIG. 2), both arranged on the support structure 120, a first dual polarized radiating element 150 configured to radiate in a first operating frequency band and arranged on the support structure 120, wherein the first radiating element 150 is fed by the first feeding circuit 130, a second dual polarized radiating element 160 configured to radiate in a second operating frequency band being lower than the first operating frequency band and arranged on the support structure 120. The second radiating element 160 is fed by the second feeding circuit 140.

Figure 2:
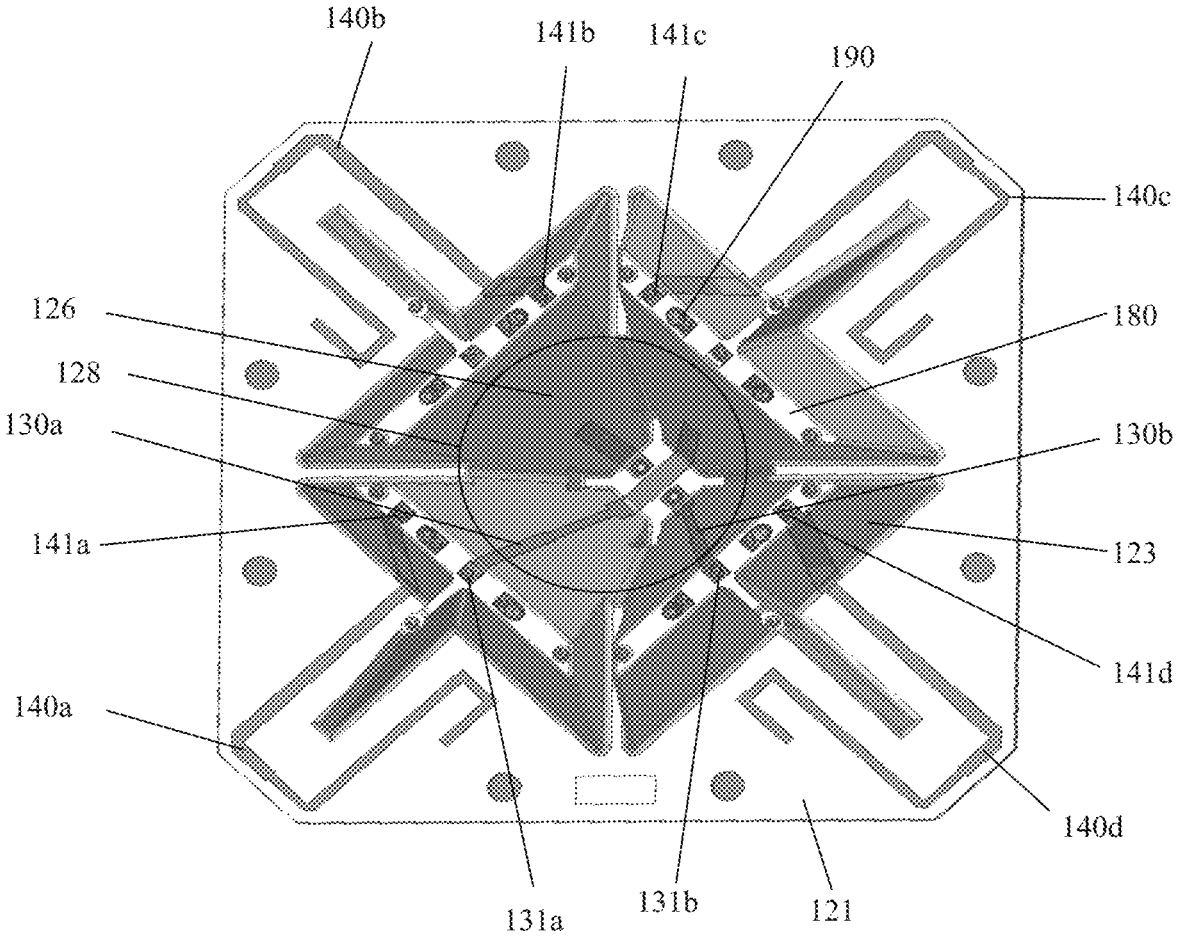
FIG. 2 shows a bottom view of a support structure of the dual-band antenna element according to the first embodiment of the present invention.

As shown in FIG. 1, the support structure 120 comprises a top portion 122, a bottom portion 124 and a first wall 126 connecting the top portion 122 and the bottom portion 124, wherein a portion of the first wall 126 surrounds a hollow area 128 (the hollow area 128 is not visible in the exploded view of FIG. 1, but can be seen in FIG. 2).

Further, the support structure 120 comprises an intermediate portion 121 and a second wall 123 connecting the bottom portion 124 and the intermediate portion 121, wherein the first wall 126 and the second wall 123 enclose cavities 125, which can also be seen in the exploded view of FIG. 1. In the embodiment of FIG. 1 four cavities 125 are provided, wherein two of the four cavities 125 can be seen in the exploded view of FIG. 1 and the other two cavities 125 are not visible due to the dome-shaped extension of the first wall 126 towards the top portion 122.

The second radiating element 160 is arranged at the intermediate portion 121 on a surface of the intermediate portion 121 facing away the bottom portion 124 of the support structure 120. Further the antenna element 100 comprises a balun metallization 132. The balun metallization 132 forms a balun for the first radiating element 150 and the second radiating element 160 and therefore for grounding the first radiating element 150 and the second radiating element 160. The balun metallization 132 extends from the top portion 122 down to the bottom portion 124 on a surface of the first wall 126 facing away from the hollow area 128 (which encloses the first wall 126) and therefore is also partly provided on the surface of the first wall 126 facing the cavities 125. Further, the balun metallization 132 can further extend along a surface of the second wall 126 facing the enclosed cavities 125 and can further extend on the surface of the intermediate portion 121 facing away from the bottom portion 124, thereby serving as a grounding plane for both, the first feeding circuit 130 and the second feeding circuit 140. Therefore, the balun metallization 132 extends on an opposed surface of the support structure 120 as the first feeding circuits 130 and the second feeding circuits 140. The intermediate portion 121 extends away from the first wall 126 in a direction perpendicular to a main extension direction, being a direction of a largest extension, of the first wall 126, wherein the intermediate portion 121 is provided in the main extension direction between the top portion 122 and the bottom portion 124 of the support structure 120. In the balun metallization 132 provided on the surface of the intermediate portion 121 facing away from the bottom portion 124 non-conductive interruptions 127, in particular slots, can be provided. Within these non-conductive interruptions 127 the balun metallization 132 is not present, i.e. interrupted. In the embodiment of FIG. 1 four slots 127 are provided, wherein two diagonally opposing slots 127 serve for providing one polarization of the radiation emitted by the second radiating element 160, so that the four slots 127 serve for providing two orthogonal polarizations for the second operating frequency band of the second radiating element 160.

Further, the second radiating element 160 can be a bended metal sheet attached to the support structure 120. The bended metal sheet is in the form of a cup-shaped element having a bottom portion 162, a top portion 164 and a wall portion 166 connecting the bottom portion 162 and the top portion 164. Further, the bottom portion 162 is formed by a sheet-like plate as can be seen in FIG. 1. Four cutouts 161 can extend from the respective corners of the sheet-like plate towards the middle of the bottom portion 162. Furthermore, in an assembled state, the second radiating element 160 is with its bottom portion 162 attached to the surface of the intermediate portion 121 facing the top portion 122 of the support structure 120 in that way that in the direction from the bottom portion 124 to the top portion 122 of the support structure 120, one cutout 161 at least partially overlaps with a corresponding non-conductive interruption 127, for example a slot, and the balun metallization 132 faces the second radiating element 160. Thereby, two diagonally opposed non-conductive interruptions 127 together with the two corresponding cutouts 161 partially overlapping with the two non-conductive interruptions 127 serve for providing one polarization, so that by the four cutouts 161 together with the four non-conductive interruptions 127 and corresponding open ended microstrip transmission lines of the second feeding circuit 140 feeding for the two orthogonal polarizations of the second radiating element 160 is provided.

Further, the second radiating element 160 can comprise in a center portion of the bottom portion 162 an opening 163 through which the support structure 120 extends from the intermediate portion 121 of the support structure 120 to the top portion 122 of the support structure 120.

Further, in the embodiment shown in FIG. 1, the second feeding circuit 140 is formed by a second metallization, wherein the second metallization is arranged on a surface of the second wall 123 facing away from the respective cavity 125 and further extends on a surface of the intermediate portion 121 facing the bottom portion 124, so that the second metallization extends from the bottom portion 124 to and on the intermediate portion 121.

In embodiments of the present invention, the first feeding circuit 130 is formed by two microstrip transmission lines 130*a*, 130*b* and second feeding circuit 140 is formed by four microstrip transmission lines 140*a*-140*d*. One of the microstrip transmission lines of the second feeding circuit 140 can also be seen in FIG. 1 on the surface of the second wall 123 facing away from cavity 125, and this microstrip transmission line extends from the bottom portion 124 up to and on the surface of the intermediate portion 121 facing the bottom portion 124. Therefore, in the embodiment of FIG. 1 four microstrip transmission lines 140*a*, 140*b*, 140*c*, 140*d* of the second feeding circuit 140 are provided, wherein in the exploded view of FIG. 1 just one microstrip transmission line is visible. The four microstrip transmission lines 140*a*-140*d* (best seen at FIG. 2) of the second feeding circuit 140 also extend along a surface of the intermediate portion 121. Each polarization of the second radiating element 160 is fed by two opposing open ended microstrip transmission lines (140*a*, 140*c* and 140*b*, 140*d*) of the second feeding circuit 140. In other words the open ended microstrip transmission lines of the second feeding circuit 140, are provided pairwise diagonally opposite to each other on the support structure 120. Each pair of open ended microstrip transmission lines provided diagonally opposite to each other serves for generating a polarization of the radiation generated by the second radiating element 160, so that the four open ended microstrip transmission lines 140*a*-140*d* of the feeding circuit 140 serve for providing two orthogonal polarizations of the radiation emitted by the second radiating element 160.

Furthermore, a first metallization forming the first feeding circuit 130 is provided. The first feeding circuit 130 can at best be seen in FIG. 2. The first feeding circuit 130 can be also by microstrip transmission lines, so that in the embodiment of FIG. 1 two open ended microstrip transmission lines 130*a*, 130*b* are provided. These two microstrip transmission lines 130*a*, 130*b* are provided on an inner surface of the first wall 126 facing the hollow area 128 and extend from the bottom portion 124 to the top portion 122. Therefore, in the exploded view of FIG. 1, the two microstrip transmission lines 130*a*, 130*b* are not visible.

Furthermore, the first radiating element 150 is provided on the top portion 122. In the embodiment of FIG. 1, the first dual polarized radiating element 150 is formed by two single polarized radiating elements 150*a*, 150*b*. Each of the single polarized radiating elements 150*a*, 150*b* is formed by two dipole arms being provided diagonally opposed to each other on a support structure 151, being for example a PCB arranged at the top portion 122. Each dipole arm is formed by a metallization on a top surface of the support structure 151. Each single polarized radiating element 150*a*, 150*b* is configured to radiate in a same first operating frequency band. Further, the first single polarized radiating element 150*a* is configured to radiate in a certain polarization being orthogonal to the polarization of the second single polarized radiating element 150*b*. The first microstrip transmission line 130*a* of the first feeding circuit 130 extending from the bottom portion 124 to the top portion 122 is configured to feed the first single polarized radiating element 150*a*. The second microstrip transmission line 130*b* of the first feeding circuit 130 extending from the bottom portion 124 to the top portion 122 is configured to feed the second single polarized radiating element 150*b*.

Furthermore, optionally, as can be seen in FIG. 1, a foot 115 can be provided at the bottom portion 124 of the support structure 120. The foot 115 comprises a first input port 116 and a second input port 117. The first input port 116 is connected to the first feeding circuit 130 and the second input port 117 is connected to the second feeding circuit 140 and at the same time the first input port 116 and the second input port 117 are both configured to be connected to a distribution network of a base station antenna.

In detail, the first input port 116 comprises a first input port terminal 116*a* and a second input port terminal 116*b*. The first input port terminal 116*a* of the first input port 116 is connected to the first microstrip transmission line 130*a* for providing a feeding for the first polarization of the dual polarized first radiating element 150. The second input port terminal 116*b* of the first input port 116 is connected to the second microstrip transmission line 130*b* for providing a feeding for the second polarization of the dual polarized first radiating element 150.

Furthermore, the second input port 117 comprises a first input port terminal 117*a* and a second input port terminal 117*b*. The first input port terminal 117*a* of the second input port 117 is connected to the first microstrip transmission line 140*a* and the third microstrip transmission line 140*c* of the first feeding circuit 140 for providing a feeding for the first polarization of the dual polarized second radiating element 160. The second input port terminal 117*b* of the second input port 117 is connected to the second microstrip transmission line 140*b* and the fourth microstrip transmission line 140*d* of the first feeding circuit 140 for providing a feeding for the second polarization of the dual polarized second radiating element 160.

Further, the bottom portion 124 of the support structure 120 can comprise pins (as further discussed with respect to FIG. 3) serving for connecting the first and second feeding circuits 130 and 140 to the foot 115 and can furthermore comprise grounding pins (as further discussed with respect to FIG. 3) serving for connecting the balun metallization 132 to the foot 115, thereby providing a grounding. In the embodiment of FIG. 1, the foot 115 is a separate PCB soldered to the support structure 120. Optionally, the foot 115 together with the support structure 120 can form the single molded part instead of forming the single molded part only by the support structure 120. Further optionally, the single molded part can be formed by the support structure 120 together with the foot 115 and the first radiating element 150 and second radiating element 160. Further, the dual band radiating element can be a molded interconnect device, MID.

The advantages achieved by the use of the molded interconnect device (MID) technology, are less number of parts, lightweight and it is suitable for mass production of antennas.

The use of the MID technology allows the integration of feeding network, radiating elements and the support structure using a minimum amount of parts. Furthermore, the resulting dual band antenna element is operational in dual bands without sacrificing radio frequency (RF) performance.

To summarize, the dual band antenna element according to the first embodiment provides for a high mechanical stability due to the provision of the support structure being a single molded part on which the first radiating element 150 and the second radiating element 160 are arranged. In addition, due to the provision of the support structure 120 as a single molded part a very simple and cost-effective manufacturing process of the dual-band antenna element 100 is possible. Furthermore, the dual-band antenna element 100 is very compact with only a few elements making up the dual-band antenna element 100, which also reduces the number of any hand-soldered joints for connecting the elements of the dual band antenna element 100. Further, since the first feeding circuit 130 and second feeding circuit 140 are provided on surfaces opposite to the surfaces on which the balun metallization 132 is provided, a cross-over junction between the feeding circuits and the balun metallization 132 can be avoided.

FIG. 2 is a bottom view of the support structure 120 of the dual-band antenna element 100 according to the first embodiment. There, in the bottom view, the hollow area 128 is visible. Further, the two microstrip transmission lines 130*a*, 130*b* of the first feeding circuit 130 are provided. Each of the two microstrip transmission lines 130*a*, 130*b* extends from the bottom portion 124 of the support structure 120 to the top portion 122. In particular, each microstrip transmission line 130*a*, 130*b* extends from an intersection area 180 of the bottom portion 124 between the first wall 126 and the second wall 123 to the top portion 122 on the surface of the first wall 126 facing the hollow area 128. The intersection area 180 is shown in FIG. 2 as a surface area enclosing the hollow area 128 and on which pins 131*a*, 131*b* for the first feeding circuit 130, pins 141*a*-141*d* for the second feeding circuit 140 and grounding pins 190 for the balun metallization 132 are provided. At the top portion 122, first microstrip transmission line 130*a* has to bypass the second microstrip transmission line 130*b* for not contacting the first microstrip transmission line 130*a*, thereby avoiding a short circuit or interference between the signals fed by the two microstrip transmission lines 130*a*,130*b*. Therefore, at the top portion 122, the second microstrip transmission line 130*b* is provided outside the hollow area 128 for not contacting the first microstrip transmission line 130*a* being provided on a surface of the top portion 122 facing the hollow area 128. Further, each of the microstrip transmission lines 130*a*, 130*b* is open ended and configured to feed a corresponding single polarized radiating element 150*a*, 150*b* of the first dual polarized radiating element 150. Hence, each microstrip transmission line 130*a*, 130*b* serves for providing one polarization, wherein the two polarizations are orthogonal to each other. On the intersection area 180, pins 131*a*, 131*b* are provided for galvanically contacting the corresponding microstrip transmission line 130*a*, 130*b*, which ensures an electrical connection of the first feeding circuit 130 to the foot 115 (being in the embodiment of FIG. 1 or 2 a printed circuit board, as already mentioned with respect to FIG. 1). Thereby, the feeding of first radiating element 150 is ensured.

Furthermore, the four microstrip transmission lines 140*a*-140*d* of the second feeding circuit 140 extend from the bottom portion 124 on a surface of the second wall 123 facing away from the corresponding cavity 125 and further extend on the surface of the intermediate portion 121 facing the bottom portion 124. In this context, four cavities 125 are provided, which are not visible in the bottom view of FIG. 2, but are only visible in a top view. Two diagonally opposite arranged microstrip transmission lines 140*a*, 140*c* and 140*b*, 140*d* serve for providing radiation in the second frequency band being lower in frequency than the first frequency band and having a certain polarization. Therefore, each pair of diagonally opposite microstrip transmission lines 140*a*, 140*c* and 140*b*, 140*d* serves for providing one polarization, so that by the four microstrip transmission lines 140*a*-140*d* the two orthogonal polarizations of the second radiating element 160 are provided.

Further, pins 141*a*-141*d* for the microstrip transmission lines 140*a*-140*d* are provided on the intersecting area 180, and each pin 141*a*-141*d* galvanically contacts a corresponding microstrip transmission line 140*a*-140*d* of the second feeding circuit 140, thereby ensuring the feeding of the second radiating element 160. Further, each pin 131*a-b* for the first feeding circuit 130 and each pin 141*a-d* for the second feeding circuit 140 is configured to be connected to the foot 115. Therefore, in this embodiment four second pins 141*a-d* for the second feeding circuit 140 are provided. All other pins shown on the intersecting area 180 are grounding pins 190 serving for ensuring a galvanic connection between the balun metallization 132 and the foot 115, thereby ensuring a grounding of the first radiating element 150 and the second radiating element 160. Of course in further embodiments some of the pins may be left floating and only serve for providing a mechanical connection between the support structure 120 and the foot 115.

Figure 3:
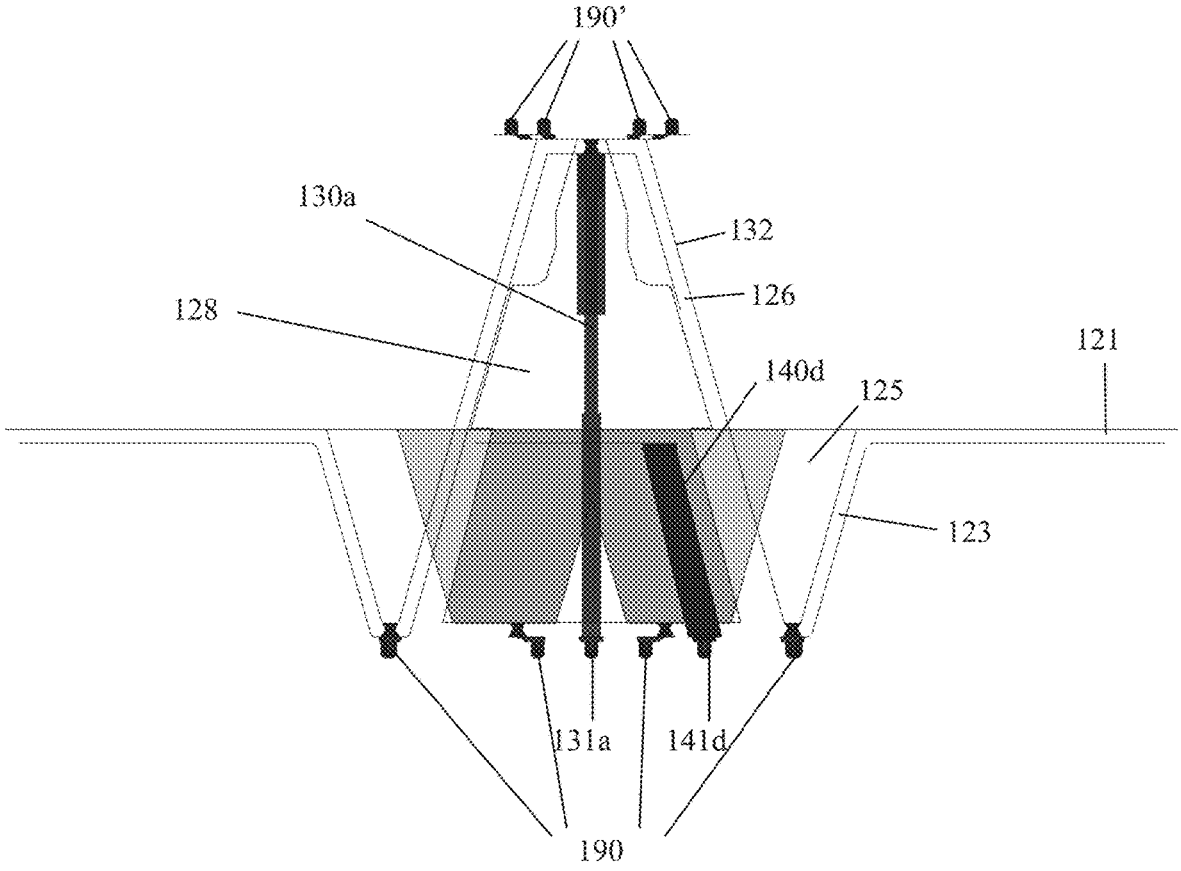
FIG. 3 shows a cross-sectional view of the support structure of the dual-band antenna element according to the first embodiment of the present invention.

FIG. 3 shows a cross-sectional view of the support structure 120 according to the first embodiment. There, the hollow area 128 is visible, which is surrounded by the first wall 126, wherein the first wall 126 extends from the bottom portion 124 to the top portion 122. Further, each of the cavities 125 is surrounded by a part of the surface of the first wall 126 facing the cavity 125 and a surface of the second wall 123 facing the cavity 125. Furthermore, a first microstrip transmission line 130*a* is shown extending from a pin 131*a* to the top portion 122. Furthermore, within the top portion 122 further grounding pins 190' are provided, which are galvanically connected to the corresponding first radiating element 150 and at the same time galvanically connected to the surface of the first wall 126 facing away the hollow area 128 on which the balun metallization 132 is provided for ensuring a grounding of the first radiating element 150. Therefore, the grounding pins 190' on the top portion 122 extend through the further support structure 151 on which the metallization of the dipole arms of the single polarized radiating elements 150*a*, 150*b* is provided, so that the grounding pins 190 contact the dipole arms. At least one grounding pin 190' galvanically contacts one dipole arm. By the provision of the grounding pins 190' not only a grounding of the first radiating element 150 can be ensured, but this also contributes for maintaining a mechanical strength, so that the first radiating element 150 (or in more detail the further support structure 151) is tightly fixed to the support structure 120. Further, an additional air gap can be achieved between the support structure 120 and the further support structure 151 by the provision of conductive pads arranged on the grounding pins 190' at the top portion of the support structure 120.

Further, in FIG. 3 one pin 141*d* for the second feeding circuit 140 is exemplary indicated. This pin 141*d* is galvanically connected to the corresponding fourth microstrip transmission line 140*d* of the second feeding circuit 140. Furthermore, grounding pins 190 are provided in the bottom portion, wherein the grounding pins 190 in the bottom portion extend from the corresponding cavity 125 through the material of the support structure 120 beyond the intersecting area 180, so that the balun metallization 132 is electrically connected to the grounding pins 190, thereby ensuring a grounding of the first radiating element 150 and the second radiating element 160. Further, the pins 131*a*-131*b* for the first feeding circuit 130, the pins 141*a*-141*d* for the second feeding circuit 140 and the grounding pins 190 in the bottom portion 124 are configured to be connected to the foot 115.

Therefore, the microstrip transmission lines 130*a*, 130*b* of the first feeding circuit 130 are provided on the surface of the first wall 126 facing the hollow area 128 and the microstrip transmission lines 140*a*-140*d* of the second feeding circuit 140 are provided on a surface of the second wall 123 facing away from the corresponding cavity 125 and on the surface of the intermediate portion 121 facing the bottom portion 124.

Further, it should be noted that the cross-sectional view of FIG. 3 shows the first embodiment with the material of the support structure 120 being transparent. This is the reason why in this cross-sectional view of FIG. 3 the fourth microstrip transmission line 140*d* of the second feeding circuit 140 is visible besides the first microstrip transmission line 130*a* of the first feeding circuit 130.

Figure 4:
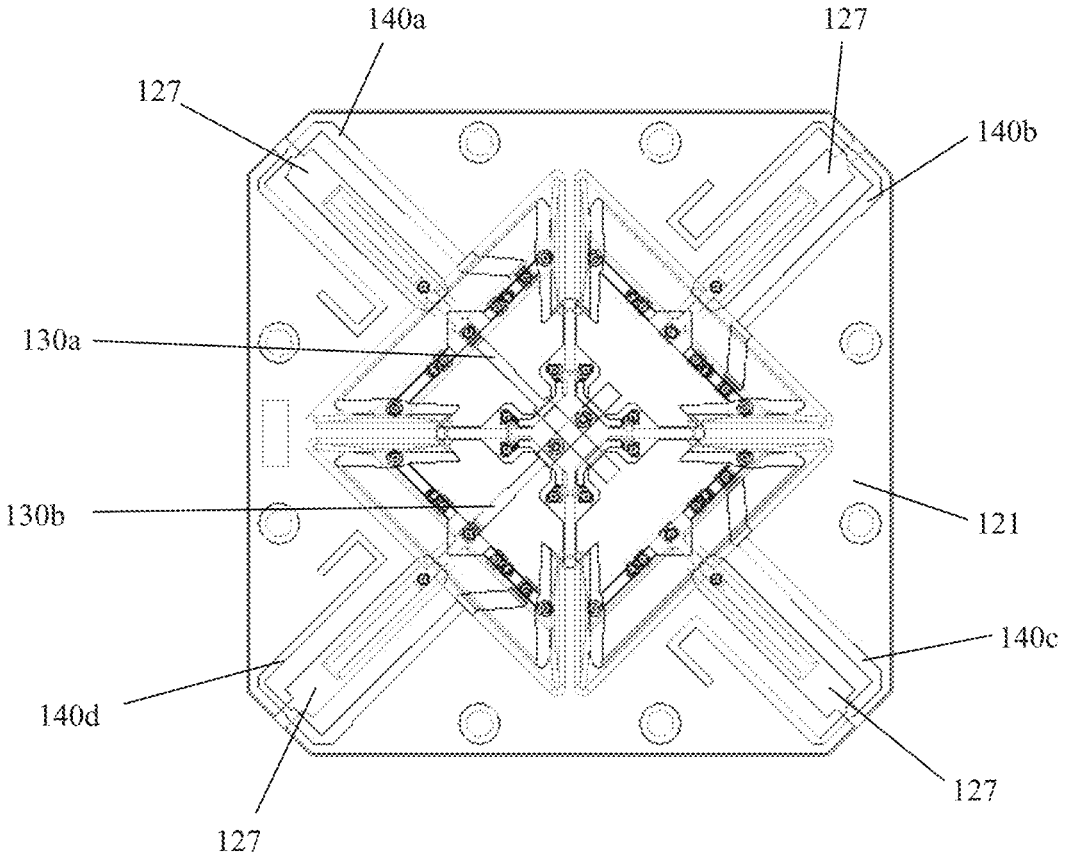
FIG. 4 shows a top view of the support structure of the dual-band antenna element according to the first embodiment of the present invention.

FIG. 4 shows a top view on the support structure 120 of the first embodiment, wherein again the material of the support structure 120 is made transparent. Therefore, in the top view, the two microstrip transmission lines 130*a*, 130*b* of the first feeding circuit 130 are visible even though the two microstrip transmission lines 130*a*, 130*b* extend on a surface of the first wall 126 facing the hollow area 128. The two microstrip transmission lines 130*a*, 130*b* extend in the top view within the top portion 122 perpendicular to each other. Further, each of the microstrip transmission lines 140*a*-140*d* of the second feeding circuit 140 partly surrounds a corresponding non-conductive interruption 127 and at the same time a portion of each microstrip transmission line 140*a*-140*d* overlaps with a corresponding non-conductive interruption 127.

Figure 5:
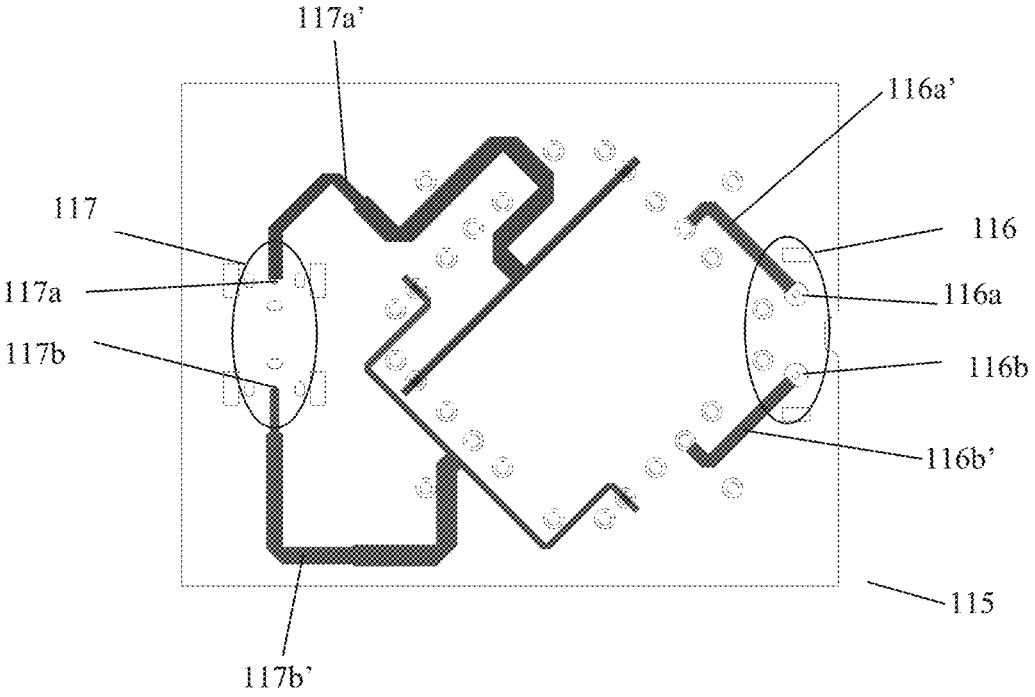
FIG. 5 shows a printed circuit board of the dual-band antenna element according to the first embodiment of the present invention.

FIG. 5 shows the foot 115 of the first embodiment of the dual-band antenna element 100. In particular, the foot 115 in that embodiment is a printed circuit board. The printed circuit board 115 comprises a first input port 116 and a second input port 117. The first input port 116 comprises a first input port terminal 116*a* and a second input port terminal 116*b*. The second input port 117 comprises a first input port terminal 117*a* and a second input port terminal 117*b*. With respect to the first input port 116, feeding lines 116*a*' and 116*b*' correspondingly extend from the corresponding first input port terminals 116*a*, 116*b* to ports within the PCB 115, which serve for connecting pins 131*a*-*b* for the first feeding circuit 130 of the support structure 120 to foot 115. Thereby, a feeding of the first feeding circuit 130 of the support structure 120 is ensured. Further, each of the two input port terminals 117*a*, 117*b* of the second input port 117 is connected to a corresponding feeding line 117*a*',117*b*', wherein each of the feeding lines 117*a*',117*b*' branches into two sub-feeding lines and each of the sub-feeding lines further extends to corresponding ports within the PCB 115, which serve for connecting pins 141*a*-141*b* for the second feeding circuit 140 of the support structure 120 to the PCB 115, thereby ensuring a feeding of the second radiating element 160. In this context, the first feeding line 116*a*' serves for providing a first polarization for the first radiating element 150 and the second feeding line 116*b*' serves for providing a second polarization being orthogonal to the first polarization for the first radiating element 150. Further, the first feeding line 117*a*' serves for providing a first polarization for the second radiating element 160 and the second feeding line 117*b*' serves for providing a second polarization being orthogonal to the first polarization for the second radiating element 160. Each sub-feeding line of the feeding lines 117*a*', 117*b*' is galvanically connected to one microstrip transmission line 140*a*-140*d* of the second feeding circuit 140.

Further, the grounding pins 190 provided in the bottom portion 124 of the support structure 120 are connected to a metal (ground) layer on the bottom side of the PCB 115 and the pins 131*a*-*b* for the first feeding circuit 130 and the pins 141*a*-141*d* for the second feeding circuits 140 are connected to a metal (signal) layer on the top side of the PCB 115.

Figure 6A:
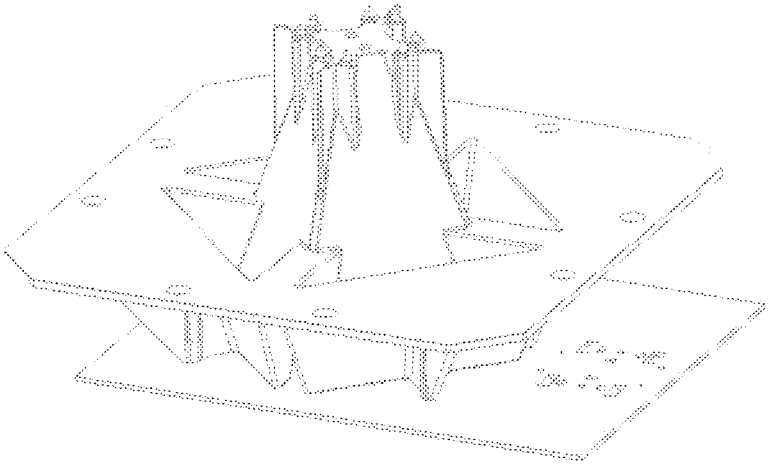
FIG. 6A shows the support structure and the printed circuit board of the dual-band antenna element according to the first embodiment of the present invention in a first assembling step.
Figure 6B:
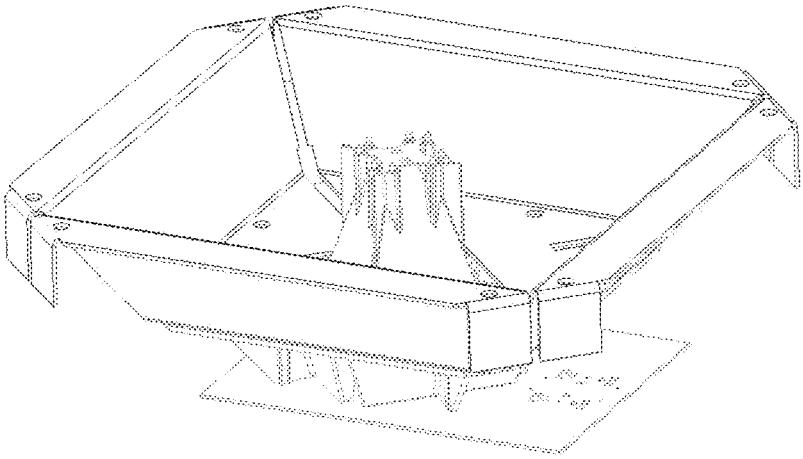
FIG. 6B shows the support structure, the printed circuit board and a second radiating element of the dual-band antenna element according to the first embodiment of the present invention in a second assembling step.
Figure 6C:
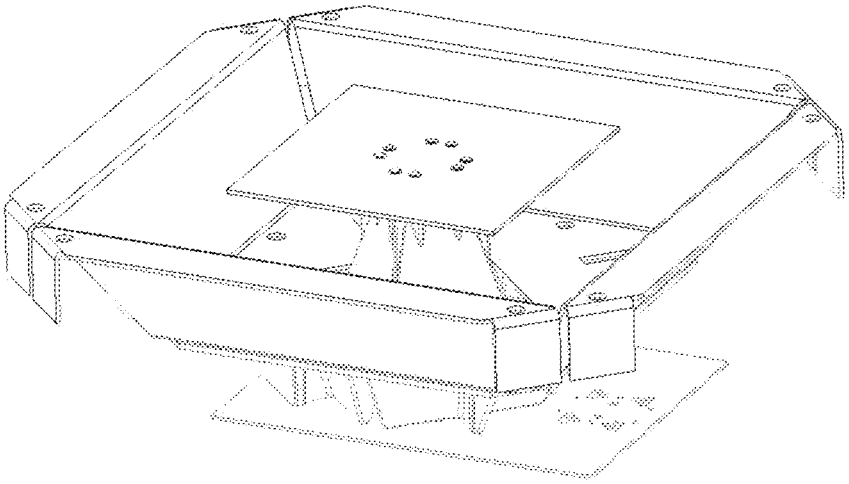
FIG. 6C shows the support structure, the printed circuit board, a first and the second radiating elements of the dual-band antenna element according to the first embodiment of the present invention in a third assembling step.

Furthermore, FIGS. 6A-6C show schematically the steps for assembling the dual-band antenna element 100 of the first embodiment. Firstly, as shown in FIG. 6A, the support structure 120 is provided on the PCB 115 in that way that the PCB 115 is soldered together with the bottom portion 124 of the support structure 120. For doing this, the pins 131*a*, 131*b* for the first feeding circuit 130 and the pins 141*a*-141*d* for the second feeding circuit 140 are provided within corresponding ports (metalized holes) provided within PCB 115 and the grounding pins 190 in the bottom portion 124 of the support structure 120 are provided in corresponding ports of the PCB 115. The support structure 120 is fixed to the PCB 115, e.g. by an automatic soldering process. In a next step, as shown in FIG. 6B, the second radiating element 160 is provided on the intermediate portion 121 of the support structure 120 in that way that a corresponding cutout 161 of the second radiating element 160 partially overlaps with a corresponding non-conductive interruption 127 of the support structure 120. The second radiating element 160 can be fixed to the support structure 120 by using e.g. plastic rivets. In a final step as shown in FIG. 6C, the first radiating element 150 is connected to the support structure 120 so that the grounding pins 190' on the top portion 122 extend through the further support structure 151 on which the first radiating element 150 is provided, thereby galvanically contacting the corresponding first radiating element 150.

Figure 7:
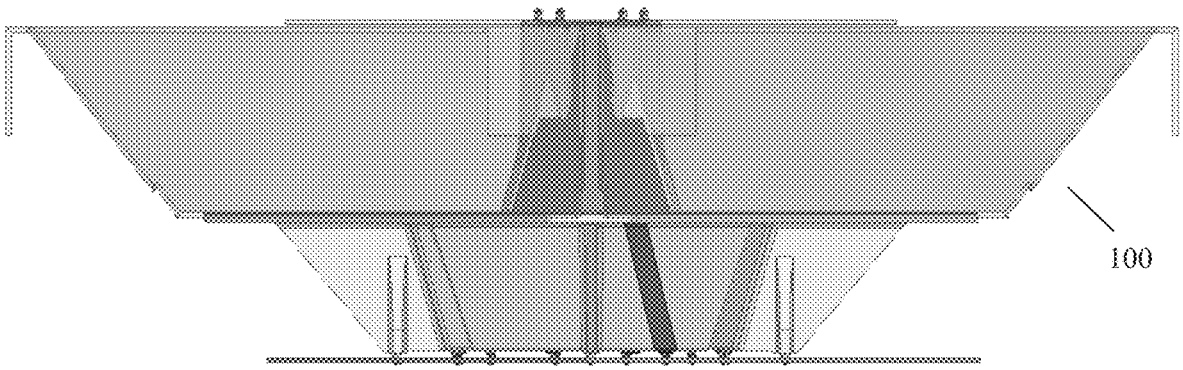
FIG. 7 shows two further views on the support structure and the second radiating element of the dual band radiating element according to the first embodiment of the present invention.
Figure 7:
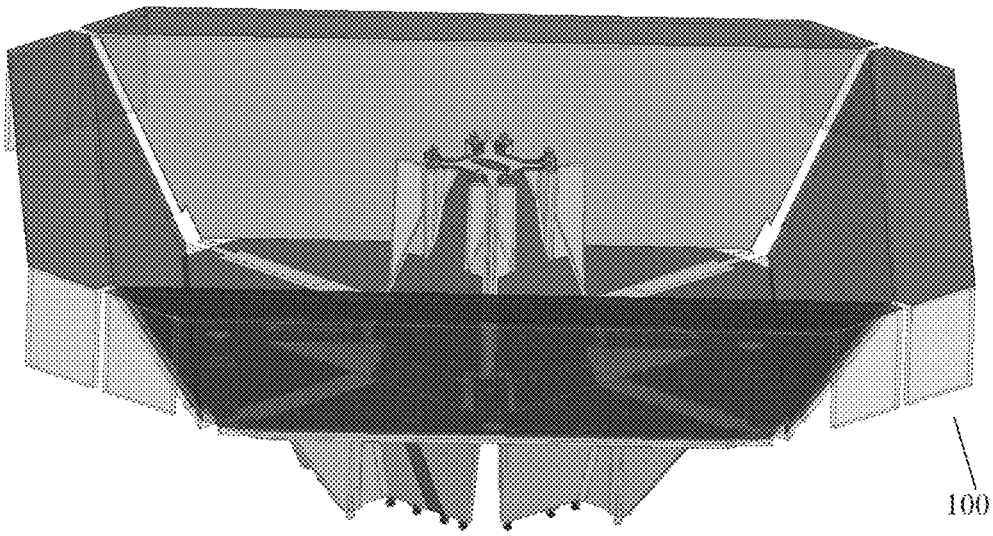

FIG. 7 shows two further views on the dual band radiating element 100 according to the first embodiment without the first radiating element 150 being arranged on the support structure 120.

Further, in a second embodiment being an alternative to the first embodiment, instead of providing the second radiating element 160 being a bended metal sheet and the support structure 120 being the single molded part, the support structure together with the second radiating element 160 may be formed by a single molded partly metallized part. In such case, the second radiating element 160 is formed by a radiating element metallization on the single molded partly metallized part. Also, in this case the partly metallized part can be formed of partly metallized plastic.

Figure 8:
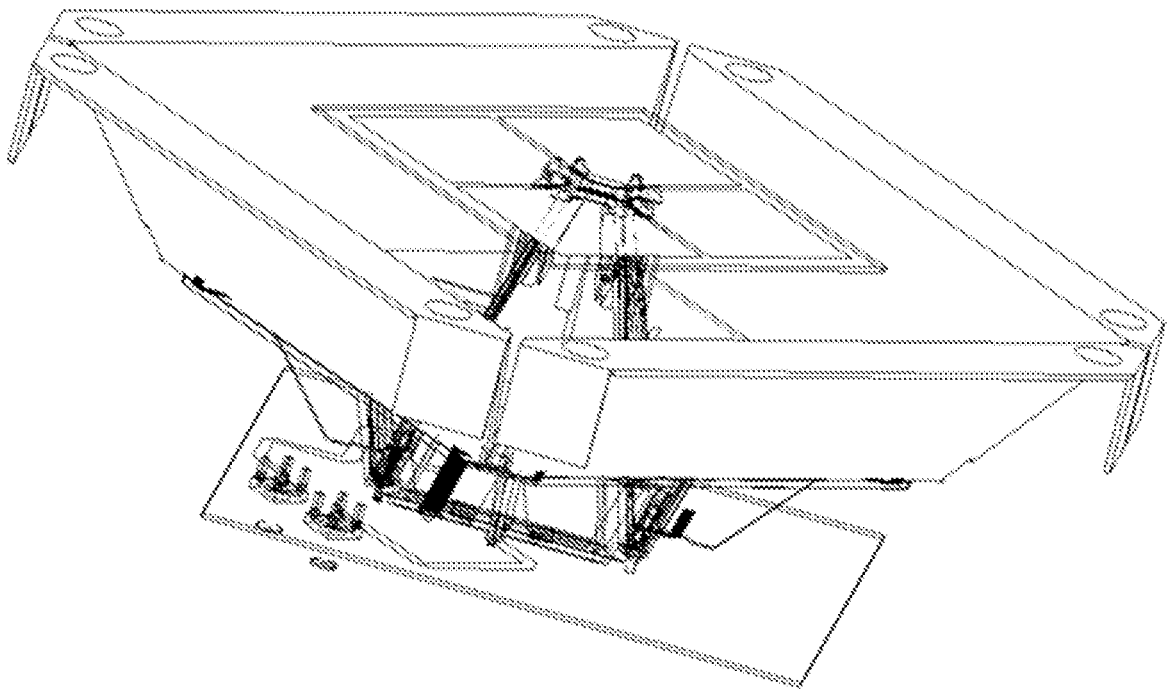
FIG. 8 shows a perspective view of the dual-band antenna element according to the first embodiment of the present invention.

FIG. 8 shows a perspective view of the dual-band antenna element 100 according to the first embodiment in an assembled state.

Figure 9:
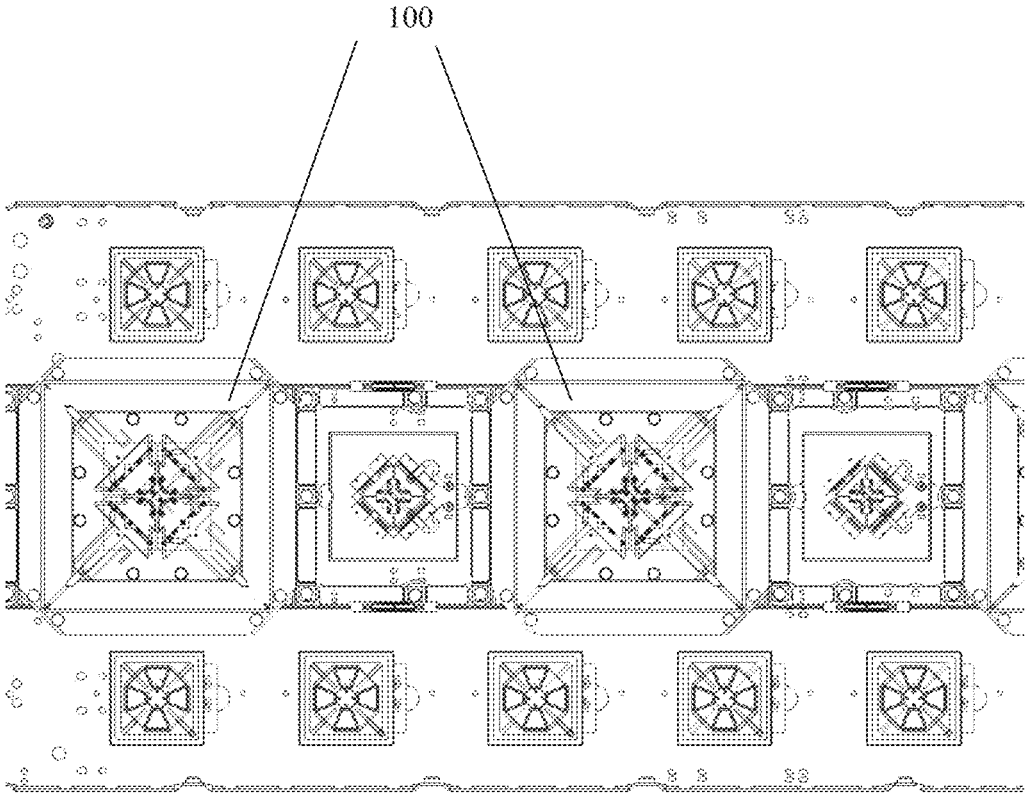
FIG. 9 shows a schematic view of a base station antenna with a plurality of dual-band antenna elements according to the first or second embodiment of the present invention.

FIG. 9 shows a base station antenna with a plurality of dual-band antenna elements according to embodiments of the present invention in an array configuration together with further radiating elements.

Figure 10:
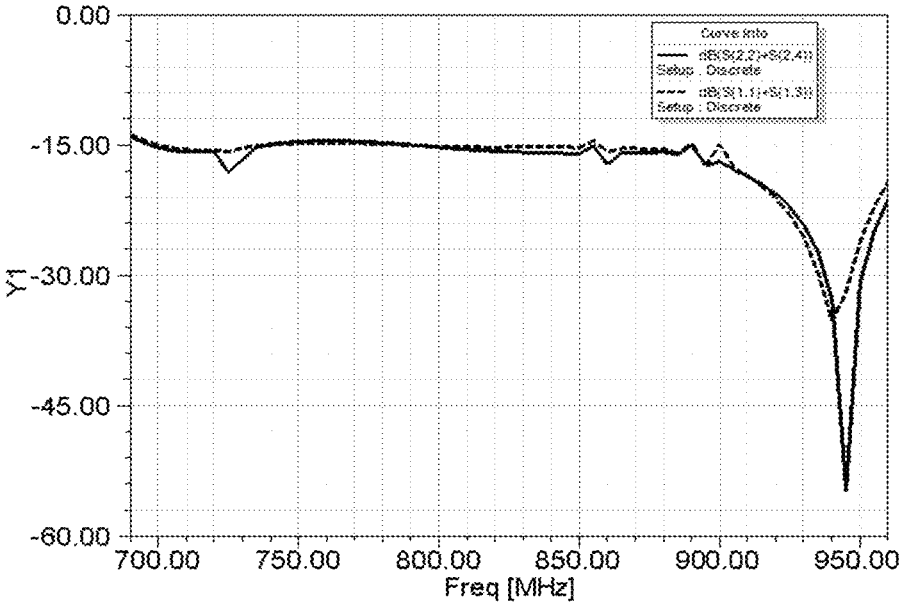
FIG. 10 shows a low frequency antenna (LFA) input matching as a function of frequency for the base station antenna of FIG. 9.
Figure 11:
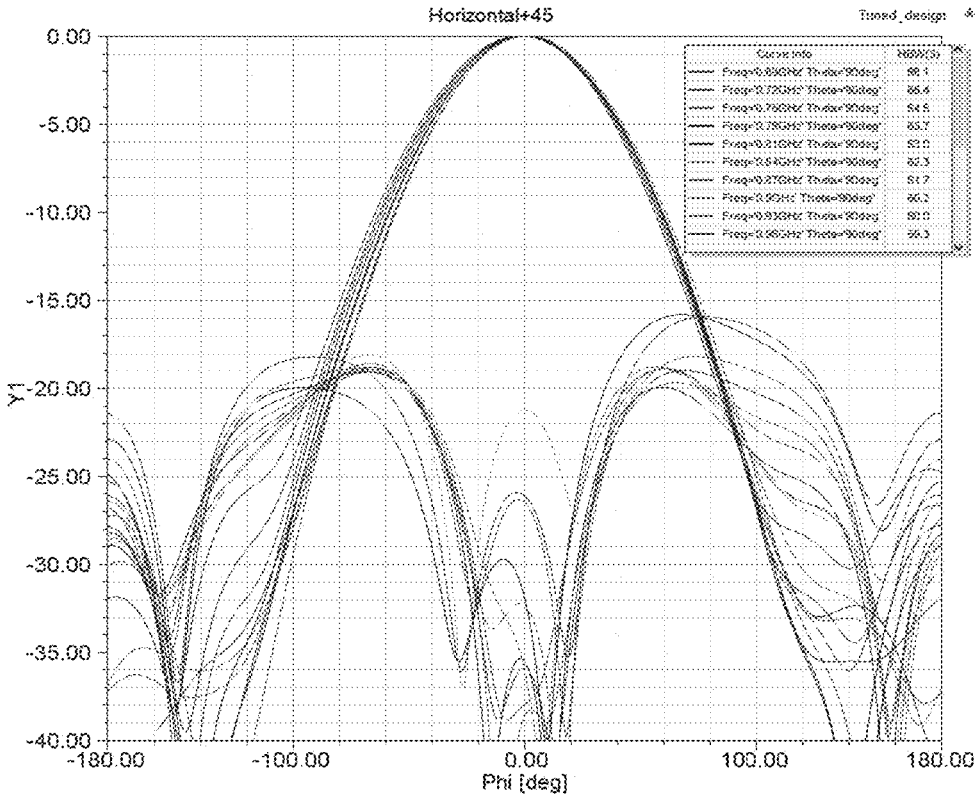
FIG. 11 shows an LFA horizontal radiation pattern for the base station antenna of FIG. 9.
Figure 12:
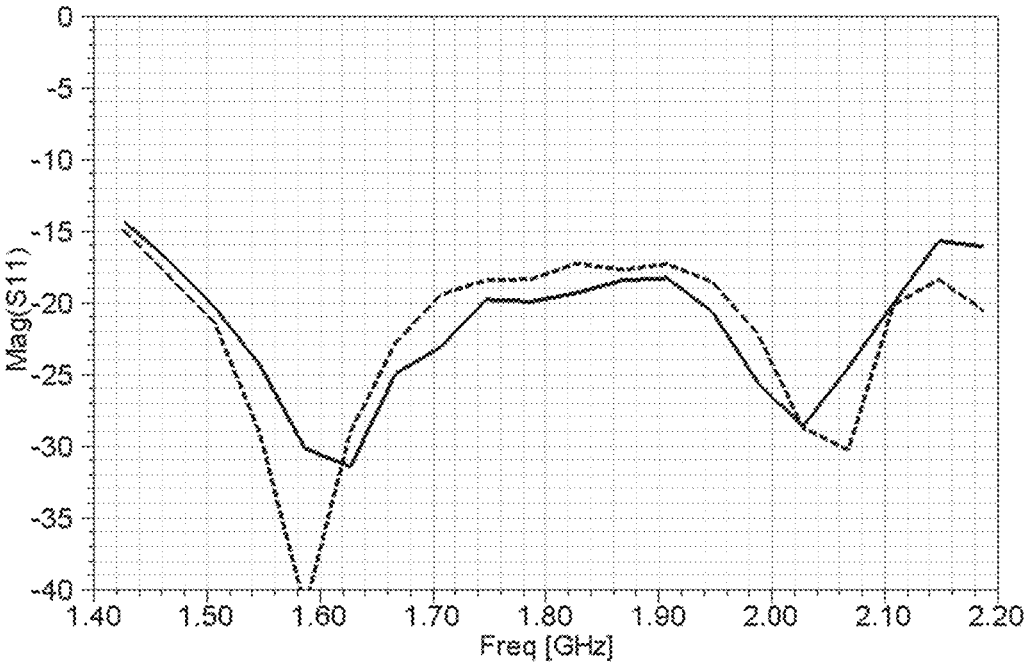
FIG. 12 shows a high frequency antenna (HFA) input matching as a function of frequency for the base station antenna of FIG. 9.
Figure 13:
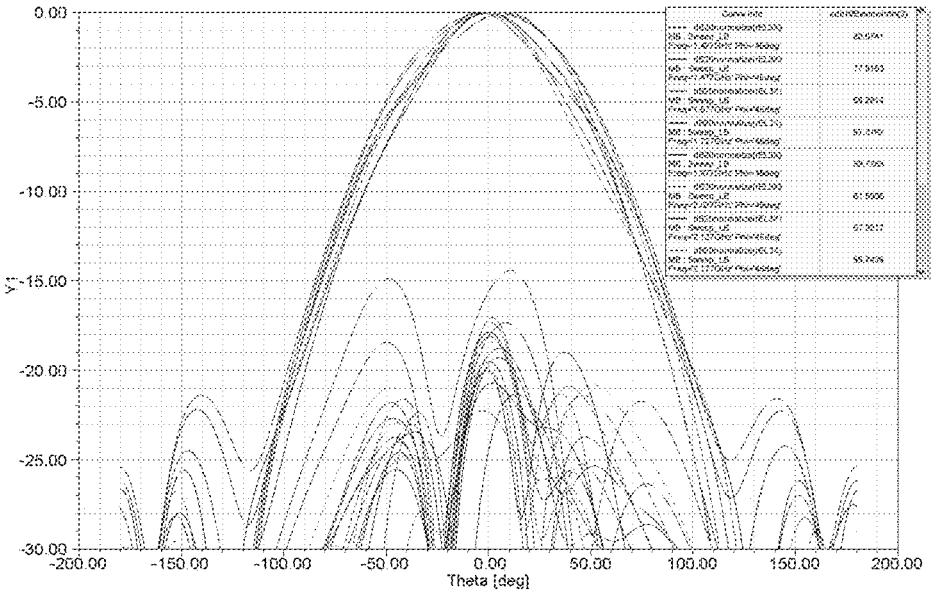
FIG. 13 shows a HFA horizontal radiation pattern for the base station antenna of FIG. 9.

FIG. 10 shows the RF performance of the base station antenna with the plurality of antenna elements of FIG. 9 dependent on the frequency. In particular, FIG. 10 shows the low frequency antenna (LFA) input matching as a function of the frequency. Further, FIG. 11 shows an LFA horizontal radiation pattern for the base station antenna according to FIG. 9. Further, FIG. 12 shows a high frequency antenna (HFA) input matching as a function of frequency for the same arrangement as in FIGS. 10 and 11. Further, FIG. 13 shows a HFA horizontal radiation pattern for the same arrangement, namely the base station antenna of FIG. 9.

Furthermore, it should be noted that the present embodiments just show examples and are not limiting. For example, the number of transmission lines of the first and second feeding circuit 130, 140 is not limited and can be arbitrary as long as the first and second feeding circuit 130, 140 serve for feeding the first and second radiating elements 150, 160 correspondingly. Furthermore, the first radiating element 150 is formed by dipoles as an example, but can be any first radiating element configured to radiate in any first operating frequency band.

Furthermore, although the radiating elements 150, 160 are dual polarized radiating elements in a further embodiment, the radiating elements could also be single polarized or even have more than two polarizations.

Similarly, the second radiating element 160 in the present embodiments is in a first alternative a bended metal sheet or in a second alternative a radiating element metallization and can be even formed as one part together with the support structure. However, this is just an example and the second radiating element can be shaped arbitrarily as long as the second radiating element is configured to radiate in a second operating frequency band being lower than the first operating frequency band of the first radiating element. Furthermore, the shape of the support structure of the discussed embodiments is just exemplary and can be any shape as long as the support structure is a single molded part. Further, the cavities and/or the hollows are optional. Further, the number of cavities can be arbitrarily chosen. Furthermore, the number of pins for the first and second feeding circuits and grounding pins and even the usage of pins instead of other connecting means is only exemplary and not limiting as long as the pins serve for its intended purposes. Furthermore, the provision of the first feeding circuit 130 on a surface of the first wall 126 facing the hollow area 128 is just exemplary and the first feeding circuit 130 in principle could also be arranged on any other surface of the support structure 120 or even within the support structure 120. Similarly, also the arrangement of the second feeding circuit 140 is just exemplary and could be provided on any surface of the support structure 120 or even within the support structure 120 as long as the feeding circuits fulfill their functions, namely that the first feeding circuit 130 is configured to feed the first radiating element 150 and the second feeding circuit 140 is configured to feed the second radiating element 160. Further, the cutouts 161 in the second radiating element 160 and/or non-conductive interruptions 127 in the intermediate portion 121 are not essential and could also be omitted. Further, the number of the cutouts 161 and/or the number of the non-conductive interruptions 127 is arbitrary. Furthermore, the example of the foot 115 being a printed circuit board is just an example not limiting the present invention and the foot 115 can be any element serving the intended purpose. Furthermore, the foot 115 in embodiments of the present invention is just an optional feature. Further, the number of ports and feeding lines within the foot 115 is arbitrary as long as the ports and/or feeding lines in the foot 115 fulfill its intended purpose.

The invention has been described in conjunction with two embodiments. However, other variations to the described embodiments can be understood and effected by those skilled in the art and practicing the claimed invention, from a study of the drawings, the disclosure and the appended claims. In these claims, the word "comprising" does not exclude other elements or steps and the indefinite article "a" or "an" does not exclude a plurality. The mere fact that certain measures are recited in mutually different dependent claims does not indicate that a combination of these measures cannot be used to advantage.

Additionally, statements made herein characterizing the invention refer to an embodiment of the invention and not necessarily all embodiments.

What is claimed is:

1. A dual band antenna element, comprising:

a support structure, wherein the support structure is a single molded part;

a first feeding circuit and a second feeding circuit both arranged on the support structure;

a first radiating element arranged on the support structure, wherein the first radiating element is configured to radiate in a first operating frequency band, and wherein the first radiating element is fed by the first feeding circuit; and a second radiating element arranged on the support structure, wherein the second radiating element is configured to radiate in a second operating frequency band that is lower than the first operating frequency band, and wherein the second radiating element is fed by the second feeding circuit.

2. The dual band antenna element according to claim 1, wherein the support structure and the second radiating element are formed by a single molded partly metalized part; and wherein the second radiating element is formed by a radiating element metallization on the single molded partly metalized part.

3. The dual band antenna element according to claim 1, wherein the second radiating element is a bent metal sheet attached to the support structure.

4. The dual band antenna element according to claim 1, wherein the support structure comprises a top portion, a bottom portion and a first wall connecting the top portion and the bottom portion, wherein at least a portion of the first wall surrounds a hollow area;

wherein the first radiating element is arranged at the top portion;

wherein the dual band antenna element further comprises a first metallization forming the first feeding circuit and a balun metallization forming a balun for the first radiating element; and wherein the first metallization and the balun metallization are arranged on opposing sides of the first wall and extend from the bottom portion to the top portion.

5. The dual band antenna element according to claim 4, wherein the support structure comprises an intermediate portion and a second wall connecting the bottom portion and the intermediate portion, wherein the first wall and the second wall enclose at least one cavity;

wherein the second radiating element is arranged at the intermediate portion;

wherein the dual band antenna element further comprises a second metallization forming the second feeding circuit; and wherein the second metallization is arranged on the second wall and extends from the bottom portion to the intermediate portion.

6. The dual band antenna element according to claim 5, wherein the balun metallization is arranged on the side of the first wall facing the at least one enclosed cavity and further extends along the side of the second wall facing the at least one enclosed cavity, thereby serving as a ground plane for both the first feeding circuit and the second feeding circuit.

7. The dual band antenna element according to claim 1, wherein the second radiating element is a cup-shaped element having a bottom portion, a top portion and a wall portion connecting the bottom portion and the top portion.

8. The dual band antenna element according to claim 7, wherein the support structure comprises a bottom portion, an intermediate portion and a top portion, wherein the support structure extends from its bottom portion, through its intermediate portion, and to its top portion;

wherein the second radiating element is arranged with its bottom portion on the intermediate portion of the support structure;

wherein the bottom portion of the cup-shaped element has an opening through which the support structure extends from the intermediate portion of the support structure to the top portion of support structure.

9. The dual band antenna element according to claim 8, wherein the first radiating element is arranged at the top portion of the support structure.

10. The dual-band antenna element according to claim 9, wherein the first radiating element is connected to a balun metallization.

11. The dual-band antenna element according to claim 1, wherein the first feeding circuit comprises an open-ended microstrip transmission line configured to feed the first radiating element and the second feeding circuit comprises a further open-ended microstrip transmission line configured to feed the second radiating element.

12. The dual band antenna element according to claim 1, further comprising a foot at a bottom portion of the support structure, the foot comprising at least a first input port and a second input port;

wherein the first input port is connected to the first feeding circuit and the second input port is connected to the second feeding circuit; and wherein the first and second input ports are configured to be connected to a distribution network of a base station antenna.

13. The dual band antenna element according to claim 12, wherein the foot is a separate printed circuit board (PCB) soldered to the support structure.

14. The dual band antenna element according to claim 12, wherein the support structure together with the foot form the single molded part.

15. The dual band antenna element according to claim 1, wherein the support structure together with the first radiating element and/or the second radiating element form the single molded part.

16. The dual band antenna element according to claim 1, wherein the first feeding circuit and the second feeding circuit are both formed by microstrip transmission lines.

17. The dual band antenna element according to claim 1, wherein the dual band antenna element is at least partly a molded interconnect device (MID).

18. A base station comprising:

a plurality of dual band antenna elements, wherein each of the plurality of dual band antenna elements comprises:

a support structure, wherein the support structure is a single molded part;

a first feeding circuit and a second feeding circuit both arranged on the support structure;

a first radiating element arranged on the support structure, wherein the first radiating element is configured to radiate in a first operating frequency band, and wherein the first radiating element is fed by the first feeding circuit; and a second radiating element arranged on the support structure, wherein the second radiating element is configured to radiate in a second operating frequency band that is lower than the first operating frequency band, and wherein the second radiating element is fed by the second feeding circuit.

* * * * *